US007410374B2

(12) United States Patent
Okuda et al.

(10) Patent No.: US 7,410,374 B2
(45) Date of Patent: Aug. 12, 2008

(54) LEVER CONNECTOR

(75) Inventors: Katsumasa Okuda, Tokyo (JP); Satoru Majima, Tokyo (JP); Hidenori Aizawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/890,394

(22) Filed: Aug. 6, 2007

(65) Prior Publication Data

US 2008/0032531 A1 Feb. 7, 2008

(30) Foreign Application Priority Data

Aug. 7, 2006 (JP) ..... 2006-214011

(51) Int. Cl.
*H01R 13/62* (2006.01)

(52) U.S. Cl. ..... 439/157; 439/372

(58) Field of Classification Search ..... 439/152–160, 439/372

See application file for complete search history.

(56) References Cited

U.S. PATENT DOCUMENTS

| | | | | |
|---|---|---|---|---|
| 5,509,816 | A * | 4/1996 | Katsuma | 439/157 |
| 6,733,313 | B2 | 5/2004 | Shinozaki et al. | |
| 6,905,355 | B2 * | 6/2005 | Fukamachi | 439/157 |
| 2005/0090156 | A1 * | 4/2005 | Majima | 439/752 |
| 2007/0207648 | A1 * | 9/2007 | Fukatsu et al. | 439/157 |
| 2008/0032531 | A1 * | 2/2008 | Okuda et al. | 439/157 |

FOREIGN PATENT DOCUMENTS

| | | |
|---|---|---|
| DE | 87 00 210 | 7/1987 |
| EP | 0 273 999 | 7/1988 |
| EP | 1 672 747 | 6/2006 |

OTHER PUBLICATIONS

European Search Report and Provisional Opinion dated Dec. 14, 2007.

* cited by examiner

*Primary Examiner*—James Harvey
(74) *Attorney, Agent, or Firm*—Collard & Roe, P.C.

(57) ABSTRACT

The lever comprises a main plate portion, a supporter portion, and an arm. The main plate portion is laid in parallel with a predetermined plane. The supporter portion extends from the main plate portion. The arm is supported by the supporting portion and is bendable in a predetermined direction. The predetermined direction is not equal to a direction perpendicular to the predetermined plane. The arm is provided with a first engagement portion. The housing comprises an accommodation portion and a second engagement portion. The second engagement portion is formed in the accommodation portion. The housing accommodates and rotatably supports the main plate portion in the accommodation portion so that the lever is provided with rotary movement between a first position and a second position. The lever connector is connected to the mating connector and the first engagement portion is engaged with the second engagement portion upon rotation of the lever from the first position to the second position.

12 Claims, 16 Drawing Sheets

LEVER CONNECTOR

BACKGROUND OF THE INVENTION

This invention relates to a lever connector having a lever, rotation of which effects connection/disconnection of the lever connector with a mating connector.

A lever connector is disclosed in U.S. Pat. No. 6,733,313B, the contents of which are incorporated herein by reference. The disclosed lever connector comprises a housing and a lever. The housing supports the lever so that the lever is rotatable between a disconnection position and a connection position in a predetermined plane. The lever is provided with a locking portion that is bendable in a direction perpendicular to the predetermined plane. Upon rotation of the lever from the disconnection position to the connection position, the locking portion is engaged with another locking portion provided to the mating connector. The lever connector is thus locked at the connection position.

There is a need for a lever connector with a low profile, especially, for a thinner lever.

SUMMARY OF THE INVENTION

According to one aspect of the present invention, there is provided a lever connector connectable with a mating connector and comprising a lever and a housing. The lever comprises a main plate portion, a supporter portion, and an arm. The main plate portion is laid in parallel with a predetermined plane. The supporter portion extends from the main plate portion. The arm is supported by the supporting portion and is bendable in a predetermined direction. The predetermined direction is not equal to a direction perpendicular to the predetermined plane. The arm is provided with a first engagement portion. The housing comprises an accommodation portion and a second engagement portion. The second engagement portion is formed in the accommodation portion. The housing accommodates and rotatably supports the main plate portion in the accommodation portion so that the lever is provided with rotary movement between a first position and a second position. The lever connector is connected to the mating connector and the first engagement portion is engaged with the second engagement portion upon rotation of the lever from the first position to the second position. The lever connector is disconnected from the mating connector upon rotation of the lever from the second position to the first position after the disengagement of the first engagement portion from the second disengagement portion by the bending of the arm.

An appreciation of the objectives of the present invention and a more complete understanding of its structure may be had by studying the following description of the preferred embodiment and by referring to the accompanying drawings.

Figure 1:
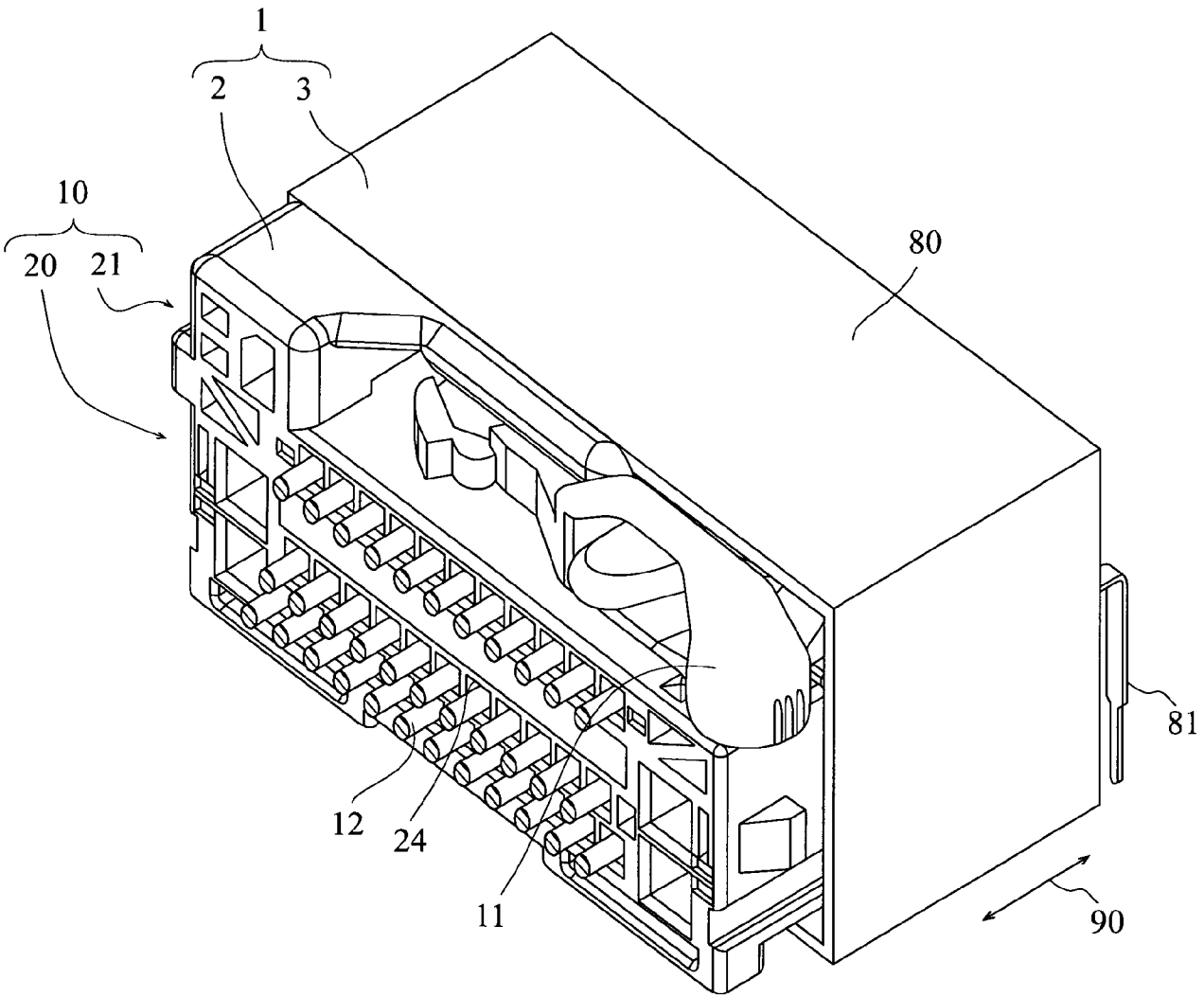
FIG. 1 is a view schematically showing a connector assembly comprised of a lever connector and a mating connector in accordance with a first embodiment of the present invention, the lever connector and the mating connector being in a connection state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector assembly 1 according to a first embodiment of the present invention comprises a lever connector 2 and a mating connector 3. The lever connector 2 and the mating connector 3 are connected with each other in a direction 90.

Figure 2:
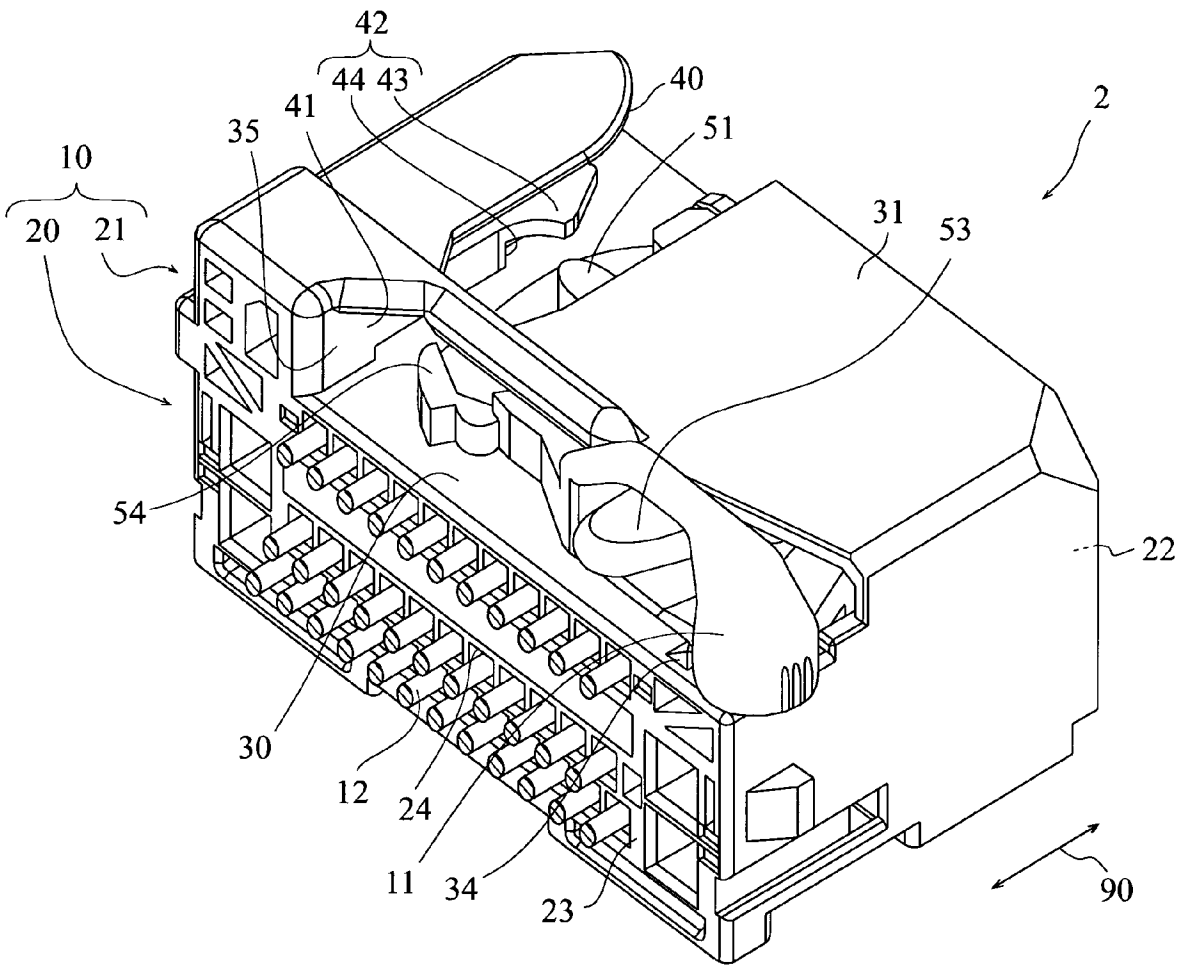
FIG. 2 is a view schematically showing the lever connector of FIG. 1, a lever of the lever connector being in a connection position.
Figure 3:
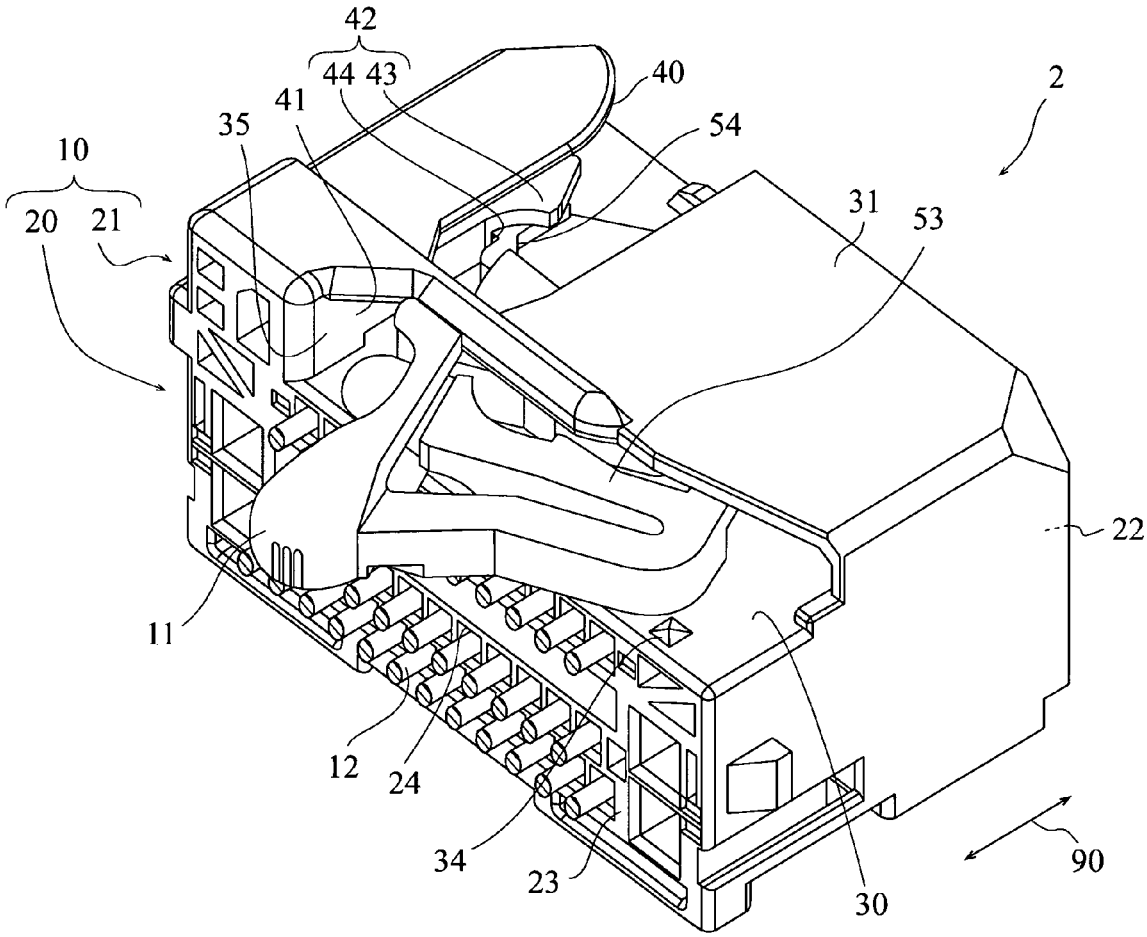
FIG. 3 is a schematic view showing the lever connector of FIG. 1, the lever being in a disconnection position.
Figure 4:
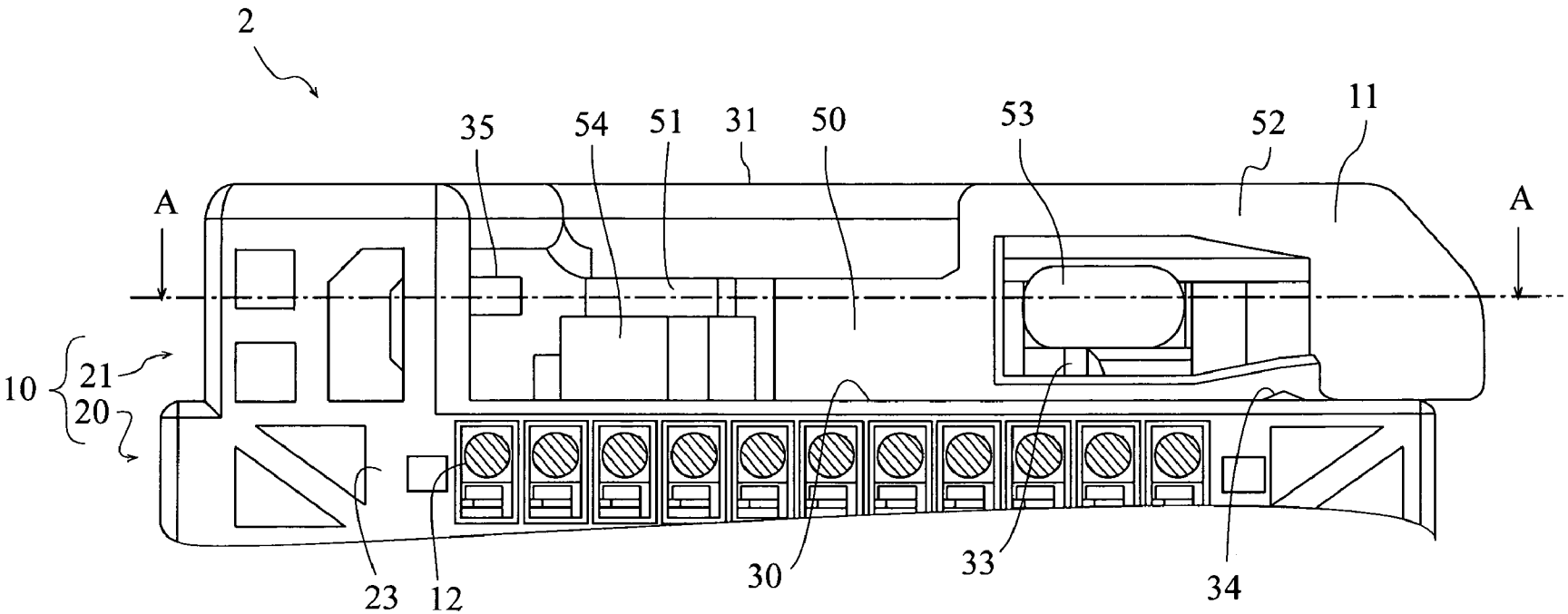
FIG. 4 is a front view schematically showing a part of the lever connector of FIG. 2, the lever being in the connection position.

Referring to FIGS. 2 and. 3, the lever connector 2 of the first embodiment comprises a housing 10, a lever 11, a plurality of wirings 12, and a plurality of connector terminals (not shown). The housing 10 is made of resin and formed with a terminal accommodation portion 20 and a lever accommodation portion 21.

The terminal accommodation portion 20 comprises a front surface 22, a back surface 23, and a plurality of wiring accommodation holes 24. The front surface 22 is perpendicular to the direction 90 and, when the lever connector 2 is mated with the mating connector 3, is inserted into the mating connector 3. The back surface 23 is also perpendicular to the direction 90. Each of the terminal accommodation holes 24 extends from the front surface 22 to the back surface 23.

The wirings 12 are inserted into the respective terminal accommodation holes 24 and are connected with the respective connector terminals within the respective terminal accommodation holes 24.

Referring to FIGS. 2 to 6, the lever accommodation portion 21 comprises a surface 30, an upper plate 31, a spindle 32, an engagement portion 33, a protrusion 34, a stopper 35, a lock portion 36, and a guide portion 40.

The illustrated surface 30 is a planar surface perpendicular to the front and the back surfaces 22, 23. The upper plate 31 is positioned above the surface 30 and is substantially in parallel with the surface 30. The surface 30 and the upper plate 31 define a space therebetween, within which the lever 11 is accommodated.

The spindle 32 has a cylindrical shape. The spindle 32 extends from the surface 30 toward the upper plate 31. The spindle 32 has an axial direction which is perpendicular to the surface 30, and a radial direction perpendicular to the axial direction.

The engagement portion 33 is formed on the surface 30. The engagement portion 33 extends toward the upper plate 31 in the axial direction. In the first embodiment, the engagement portion 33 has a contact plane 37 perpendicular to the surface 30.

The protrusion 34 is formed on the surface 30 and is positioned near to the back surface 23 and one of side surfaces of the housing 2.

The stopper 35 has a bar-like shape and is bendably supported by the housing 10. The stopper 35 is positioned between the surface 30 and the upper plate 31 and extends from the back surface 23 towards the front surface 22. The stopper 35 has a base end 41 and a free end 42. The base end 41 is positioned close to the back surface 23. The free end 42 is positioned inside the lever accommodation portion 21. The stopper 35 is bendable in a plane parallel to the surface 30. The free end 42 is provided with a protrusion portion 43 and an engagement portion 44. The protrusion portion 43 protrudes toward the spindle 32. The engagement portion 44 is formed beneath the protrusion portion 43 and faces to the surface 30.

The lock portion 36 is formed on the surface 30 and is positioned close to the front surface 22.

The guide portion 40 is an opening portion formed in the upper plate 31 and is positioned close to the front surface 22.

Figure 5:
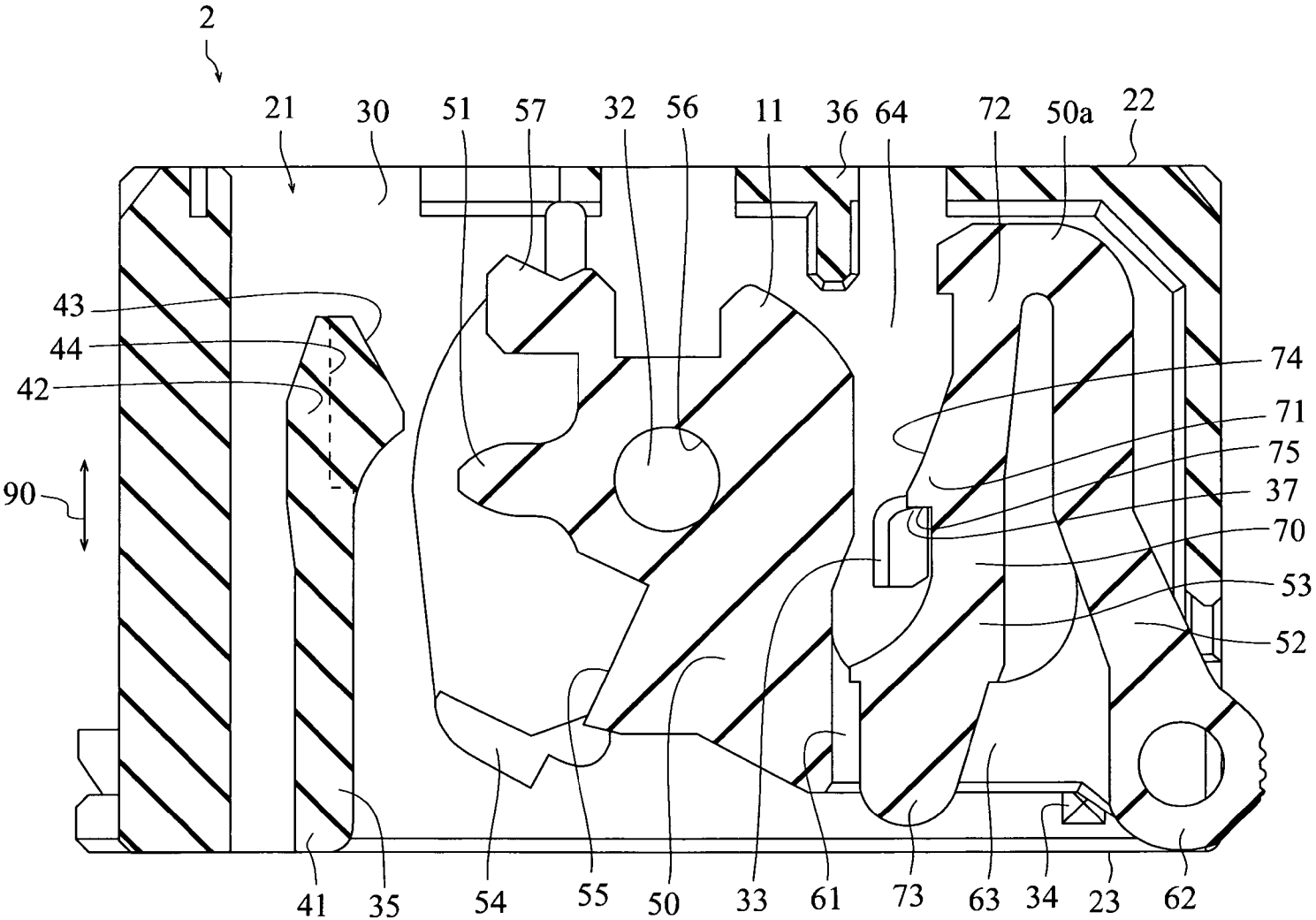
FIG. 5 is a cross-sectional view schematically showing the lever connector taken along lines A-A of FIG. 4, the lever being in the connection position.
Figure 6:
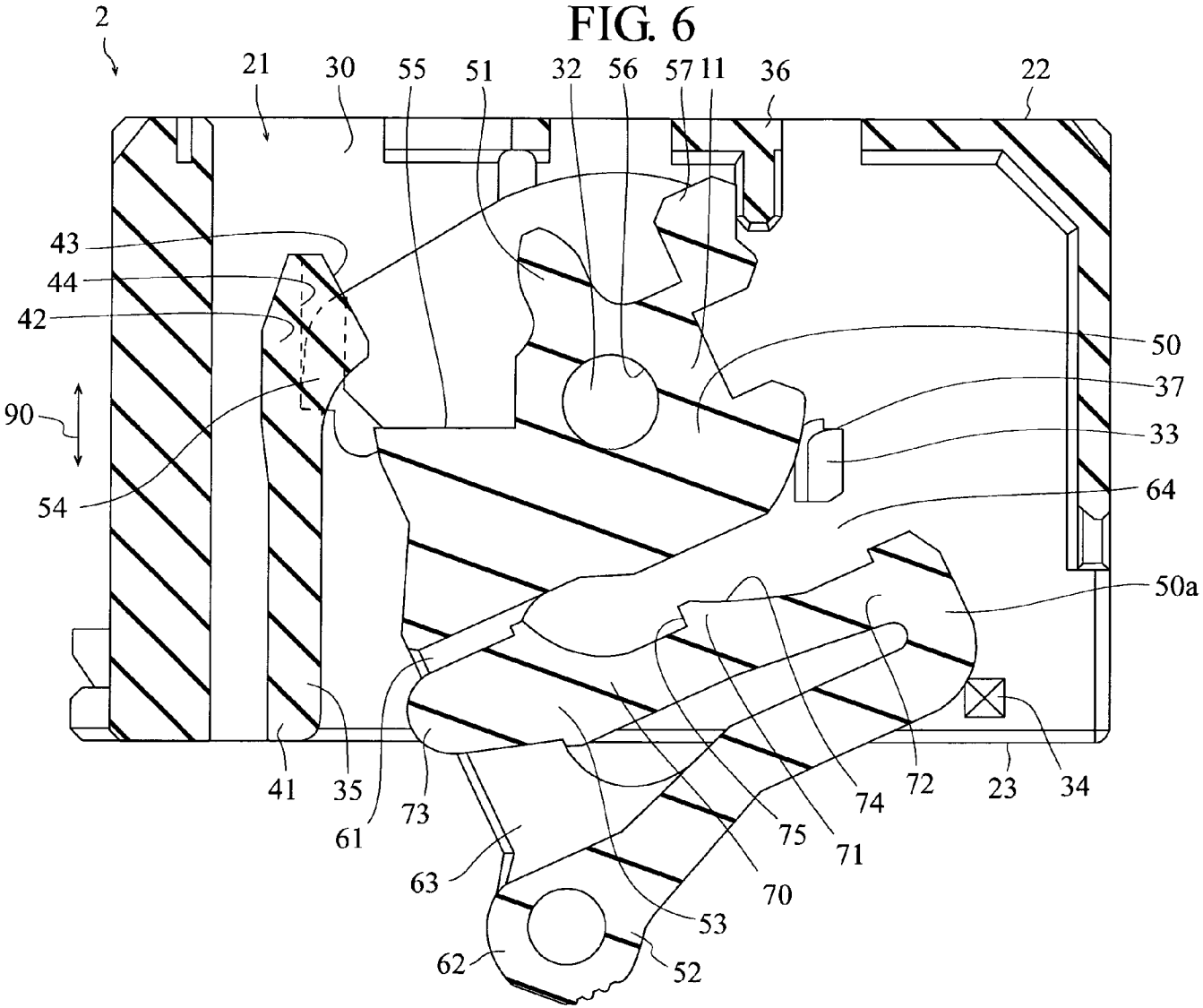
FIG. 6 is a cross-sectional view schematically showing the lever connector taken along lines A-A of FIG. 4, the lever being in the disconnection position.
Figure 7:
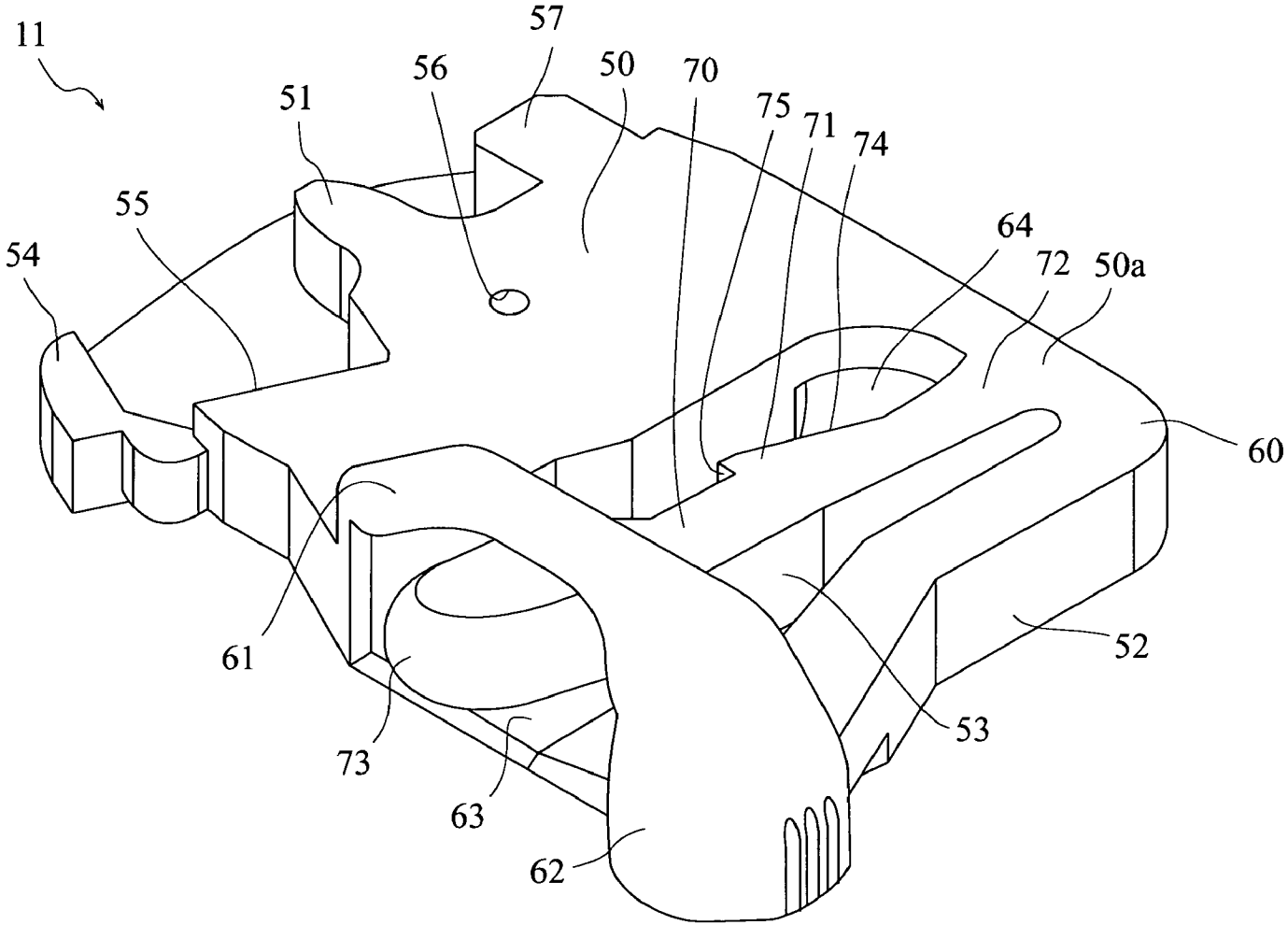
FIG. 7 is a view schematically showing the lever included in the lever connector of FIG. 2.

Referring to FIG. 7 together with FIGS. 2 to 6, description will be made about the lever 11. The lever 11 of the first embodiment is integrally formed of a single material.

The lever 11 of the first embodiment comprises a main plate portion 50, a lever cam portion 51, a supporter portion 50*a*, a guard portion 52, an arm 53, an engagement portion 54, a surface 55, a hole 56, and a lock portion 57.

The main plate portion 50 has a plate-like shape. The hole 56 is formed in the main plate portion 50 to penetrate the main plate portion 50 in the axial direction. The hole 56 has increased diameters with its depth. The diameter of the hole 56 near the surface 30 is larger than the diameter near the upper plate 31. The spindle 32 is inserted into the hole 56 from an under side of the main plate portion 50 so that the main plate portion 50 is rotatably supported in the lever accommodation portion 21.

The above-described structure of the first embodiment provides the lever 11 with the rotary movement between a first position (connection position) and a second position (disconnection position). FIG. 5 shows the lever 11 in the first position. In the first position, the lever connector 2 and the mating connector 3 are connected. FIG. 6 shows the lever 11 in the second position. In the second position, the lever connector 2 and the mating connector 3 are disconnected.

The lever cam portion 51 of this embodiment is a pinion tooth extending from the main plate portion 50 along a direction perpendicular to the axial direction. In other words, the pinion tooth projects from the main plate portion 50 along the radial direction of the spindle 32.

The supporter portion 50*a* extends from the main plate portion 50, especially, from a corner of the main plate portion 50 to its end portion 60.

The guard portion 52 is formed of a long portion and a short portion so as to form an L-shape, as seen from the above. The guard portion 52 extends from the supporter portion 50*a* and from the main plate portion 50. The long portion of the guard portion 52 extends from the end portion 60 of the supporter portion 50*a*. Namely, one end of the long portion is connected to the end portion 60 of the supporter portion 50*a*. The short portion of the guard portion 52 extends between another corner 61 of the main plate portion 50 and the other end of the long portion of the guard portion 52.

The guard portion 52 is formed with a handle portion 62. The handle portion 62 is a nonskid handle provided with some recesses which help the lever 11 to be easily operated. The handle portion 62 is positioned at a corner of the guard portion 52, i.e. a contact point of its long portion and its short portion.

The short portion of the guard portion 52 is comprised of two sub-portions, each of which is connected between the main plate portion 50 and the handle portion 62 and is separated from the other in the axial direction so that the sub-portions and the long portion as well as the main plate portion 50 define a space 63.

The supporter portion 50*a* has a guide portion 64 at a point of connection between the main plate portion 50 and the supporter portion 50*a*. A part of the supporter portion 50*a* has a thickness in the axial direction thinner than the main plate portion 50 thereby to form the guide portion 64.

The arm 53 has a bar-like shape and extends from the supporter portion 50*a* through the space 63 of the short portion of the guard portion 52 beyond the short portion. The arm 53 has a main portion 70, an engagement portion 71, a base end 72 and a free end 73. The base end 72 is integrally formed with the supporter portion 50*a*. The free end 73 has a rounded shape and projects through the space 63 beyond the short portion of the guard portion 52. The arm 53 is bendable in a predetermined direction perpendicular to the axial direction. The base end 72 has a width in the predetermined direction and a thickness in the axial direction. The width of the base end 72 is smaller than the thickness so that the arm 53 is easy to be bent in the predetermined direction. In this embodiment, the free end 73 has another width which is larger than the width of the base end 72.

The engagement portion 71 is integrally formed with the main portion 70 and is positioned between the base end 72 and the free end 73. The engagement portion 71 protrudes from the main portion 70 in the predetermined direction toward the hole 56. The engagement portion 71 has a pressed portion 74 and a contact portion 75. The pressed portion 74 gently slopes toward the free end 73. The contact portion 75 is positioned at the end of the slope of the pressed portion 74. The contact portion 75 has a surface perpendicular to the main plate portion 50 and is designed to receive the contact portion 37 of the engagement portion when the lever is perpendicular at the connection position.

The engagement portion 54 extends from the main plate portion 50. The engagement portion 54 has a thickness thinner than the main plate portion 50. The engagement portion 54 is designed so that the engagement portion 54 is engaged with the engagement portion 44 when the lever 11 is positioned at the disconnection position.

The surface 55 is perpendicular to the main plate portion 50 and is positioned between the lever cam portion 51 and the engagement portion 54. In other words, the lever cam portion 51, the engagement portion 54 and the surface 55 form a pocket, as seen along the axial direction.

The lock portion 57 extends from the main plate portion 50. The lock portion 57 is designed so that the lock portion 57 is brought into contact with the lock portion 36 when the lock portion 57 is positioned at the disconnection position. The contact of the lock portions 57 and 36 prevent the lock portion 57 from the counter clockwise rotation thereof beyond the lock portion 36.

The lever 11 is accommodated in the lever accommodation portion 21 such that the main plate portion 50 is parallel to the surface 30. When the lever 11 is in the connection position, both of the handle portion 62 and the free end 73 of the arm 53 are positioned close to the back surface 23, as best shown in FIG. 5. When the lever 11 is in the disconnection position, the handle portion 62 protrudes from the back surface 23, as best shown in FIG. 6.

Referring now to FIG. 1, the mating connector 3 includes a housing 80 and a plurality of connector terminals 81. The housing 80 is formed so as to cover a part of the housing 10 upon connection of the lever connector 2 and the mating connector 3. The connector terminals 81 are held by the housing 80. Upon the connection of the lever connector 2 and the mating connector 3, the connector terminals 81 are guided into the respective wiring accommodation holes 24 of the terminal accommodation portion 20 and are connected with the respective connector terminals in the housing 10. Outside the housing 80, each of the connector terminals 81 is connected to other elements such as a substrate.

Figure 8:
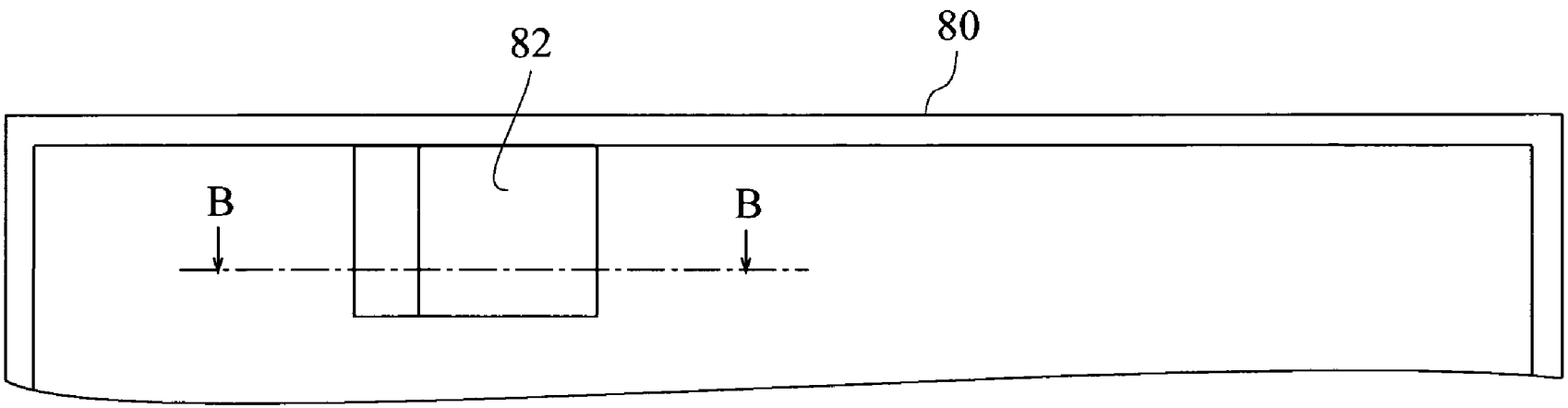
FIG. 8 is a front view schematically showing a part of the mating connector of FIG. 1.
Figure 9:
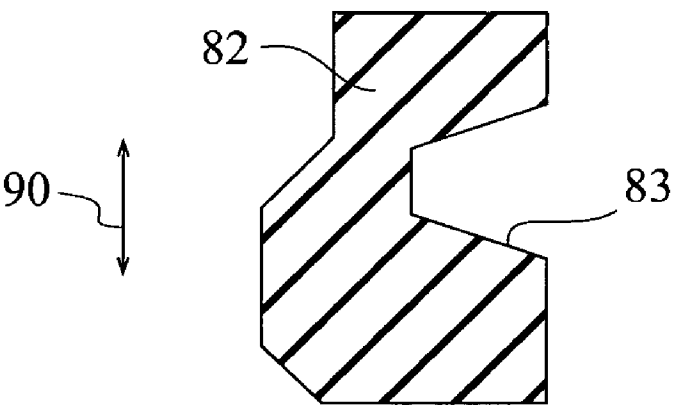
FIG. 9 is a cross-sectional view schematically showing a mating cam portion included in the mating connector, taken along lines B-B of FIG. 8.

Referring to FIG. 8, the housing 80 is provided with a mating cam portion 82 extending inside the housing 80. As shown in FIG. 9, the mating cam portion 82 is provided with an engagement portion 83. The engagement portion 83 of this embodiment is a shape which is recessed in a direction perpendicular to the direction 90. The shape of the engagement portion 83 corresponds to the engagement portion 51 of the lever 11.

Description will be made about processes of the connection of the lever connector 2 and the mating connector 3, with reference to FIGS. 6 and 10 to 12. Herein, FIGS. 10 to 12 simply show the mating cam portion 82 of the mating connector 3. Other members of the mating connector 3 are omitted from the drawing for the purpose of simplifying the description.

Figure 10:
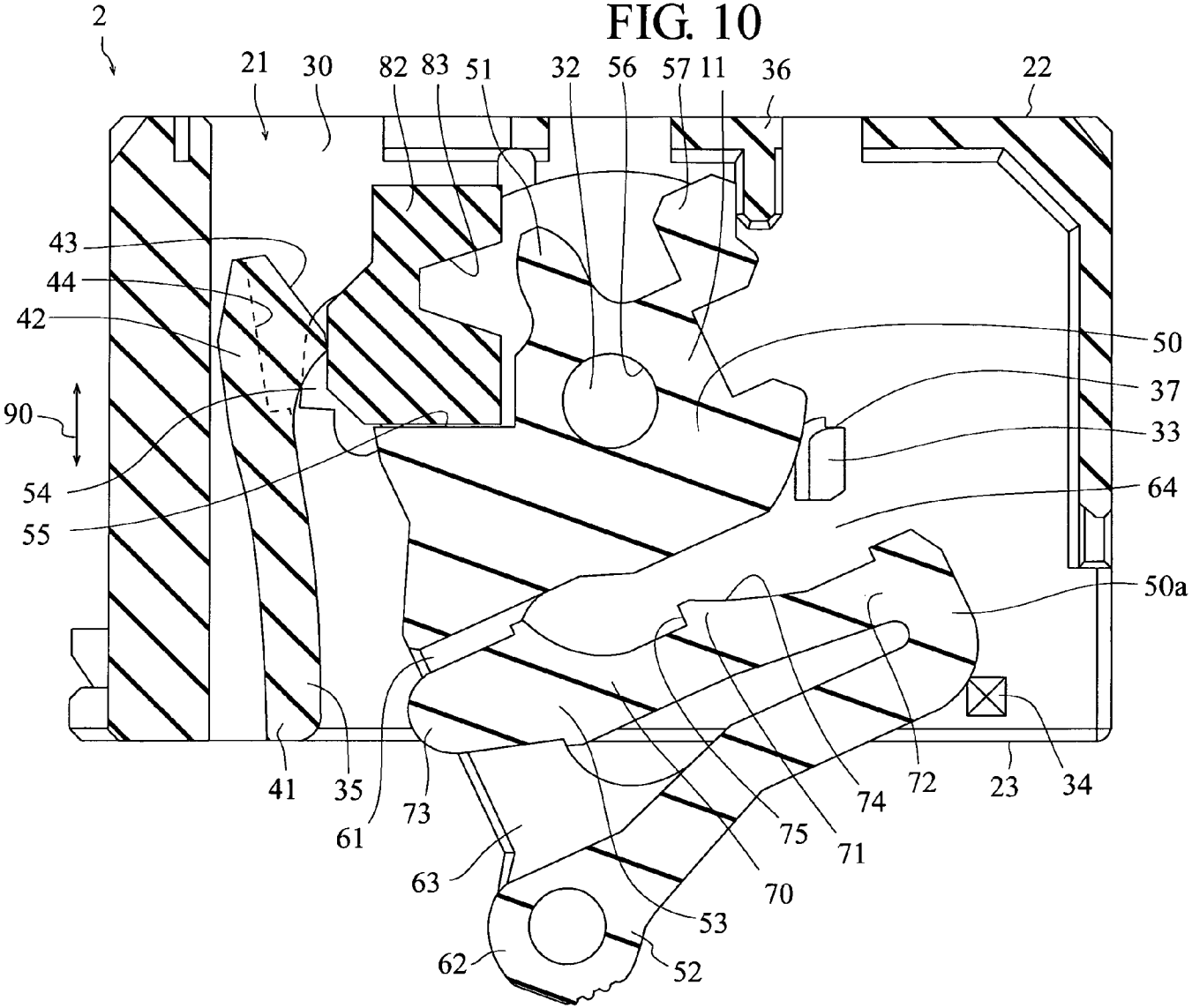
FIG. 10 is a cross-sectional view schematically showing the lever connector of FIG. 6 and the mating cam portion of FIG. 9 in a disconnection state.

Referring to FIG. 6, the lever 11 is in the disconnection position. The engagement portion 54 is engaged with the engagement portion 44. The lock portion 57 is brought into contact with the lock portion 36. Under this state, the handle portion 62 protrudes from the lever accommodation portion 21, and the engagement portion 33 is positioned at an entrance of the guide portion 64. In addition, the pocket constituted by the lever cam portion 51, the engagement portion 54 and the surface 55 opens in the direction 90 so that, as shown in FIG. 10, the pocket can receive the mating cam portion 82 when the lever connector 2 is mated with the mating connector 3. When the mating cam portion 82 is inserted through the guide portion 40 and the above-mentioned pocket receives the mating cam portion 82, the mating cam portion 82 is brought into contact with the protrusion portion 43 and presses the protrusion portion 43 so that the stopper 35 is bent away from the mating cam portion 82. Thus, the engagement portion 44 moves apart from the engagement portion 54 and is disengaged from the engagement portion 54. This enables the lever 11 to be rotated toward the connection position.

Figure 11:
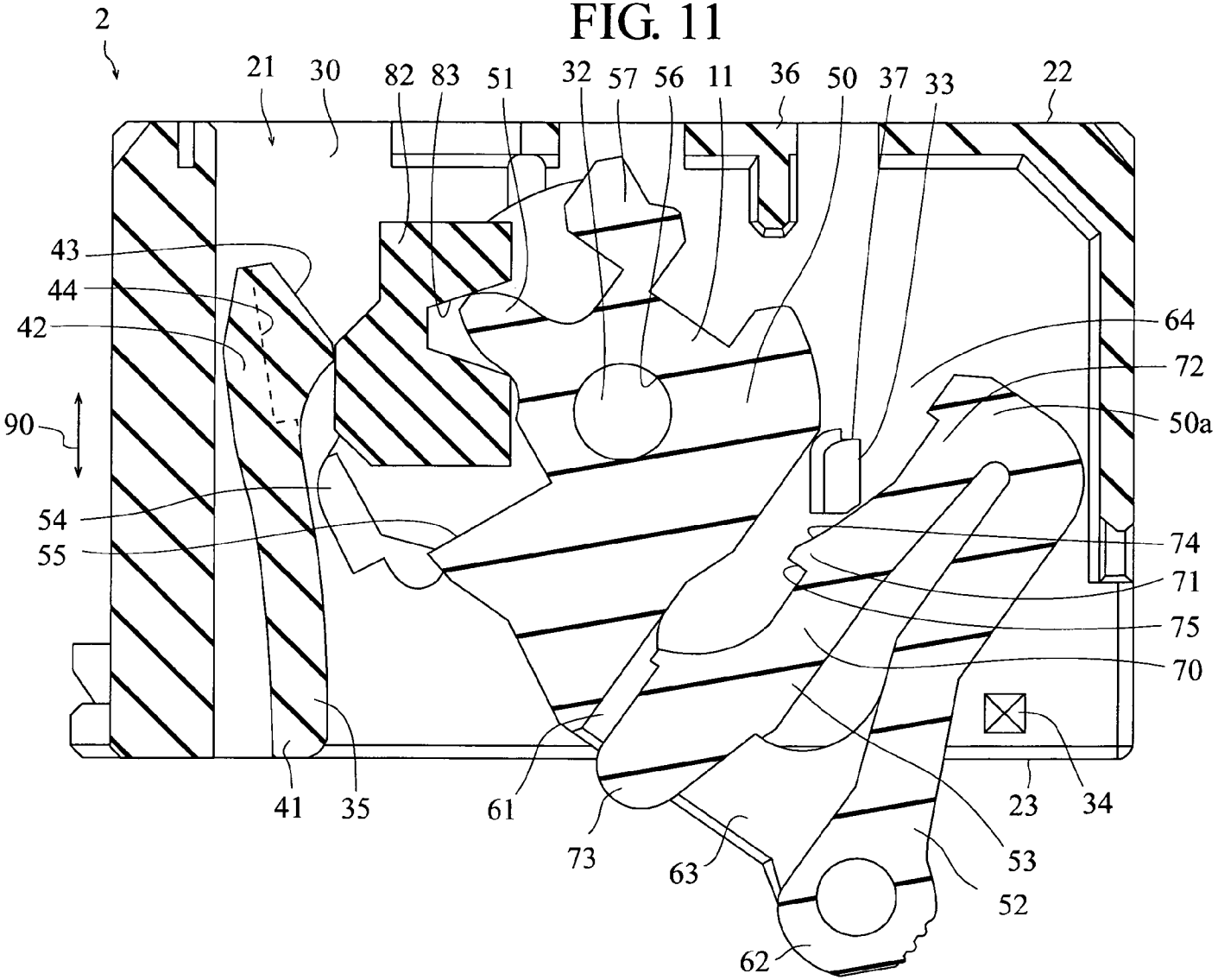
FIG. 11 is a cross-sectional view schematically showing the lever connector and the mating cam portion of FIG. 10 in an in-progress state.

Referring to FIG. 11, the lever 11 is rotated in an anticlockwise direction toward the connection position by pushing the handle portion 62 into the lever accommodation portion 21. Upon the rotation of the lever 11, the lever cam portion 51 moves in the engagement portion 83 of the mating cam portion 82 so that the mating cam portion 82 is pulled into the lever connector 2 by the engagement portion 51. The engagement portion 33 passes through the guide portion 64 and is brought into contact with the pressed portion 74. The engagement portion 33 slides on the pressed portion 74, while pressing the pressed portion 74 outwardly in the radial direction so that the arm 53 is bent in the predetermined direction. As understood from the movement, the engagement portion 33 has a shape that forces the arm 53 to be bent in the predetermined direction.

Figure 12:
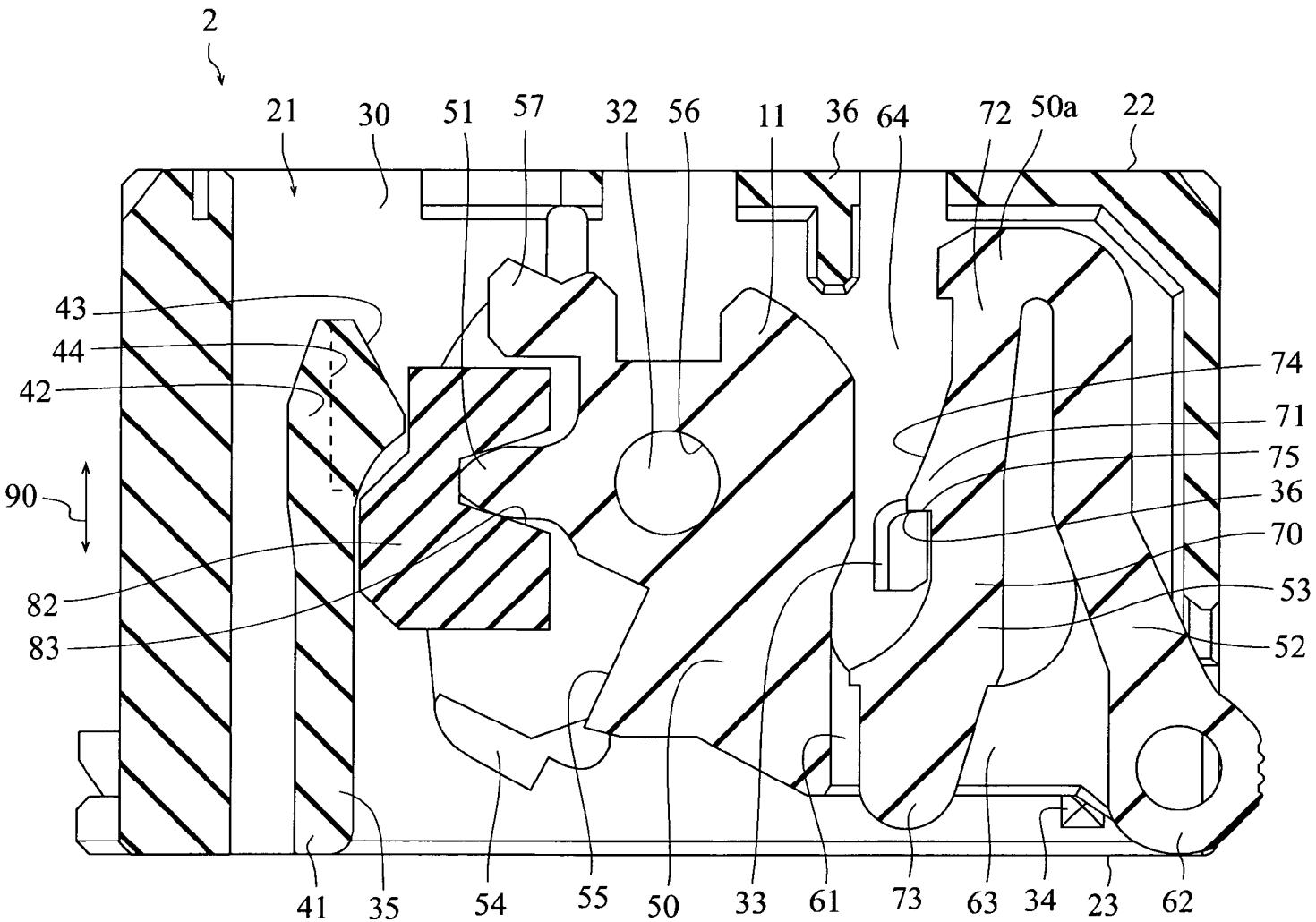
FIG. 12 is a cross-sectional view schematically showing of the lever connector of FIG. 5 and the mating cam portion of FIG. 9 in a connection state.

When the lever 11 is further rotated toward the connection position, the lever cam portion 51 is engaged with the engagement portion 83. The mating cam portion 82 gets over the protrusion portion 43 so that the stopper 35 returns to its initial state. Likewise, the engagement portion 33 gets over the pressed portion 74, and the arm 53 returns to its initial state. Thus, as shown in FIG. 12, the contact plane 37 of the engagement portion 33 is received by the contact portion 75 so that the lever 11 is locked at the connection position and is prevented from clockwise rotation away from the connection position towards the disconnection position. In this embodiment, the guard portion 52 also gets over the protrusion 34 upon the rotation of the lever 11 from the disconnection position to the connection position so that the lever 11 is further prevented from the clockwise rotation. Under this state, the lever connector 2 is completely connected with the mating connector 3.

In order to disconnect the lever connector 2 from the mating connector 3, the free end 73 of the arm 53 together with the handle portion 62 is pinched so that the arm 53 is bent toward the handle portion 62 in the predetermined direction. Thus, the lock of the lever 11 is released. Under this state, the handle portion 62 is moved so that the lever 11 is rotated in a clockwise direction. During the lever 11 is rotated from the connection position to the disconnection position, the mating cam portion 82 and the lever cam portion 51 perform operations reverse to the above-mentioned operations upon the connection so that the mating connector 3 is pushed out from the lever connector 2.

The connector assembly 1 may be modified. For example, the lever 11 may comprise a plurality of pinion teeth as the engagement portion. The mating connector 3 may have a cam pin which is engaged with a recess provided to the lever 11 for pulling the mating connector toward the lever connector 2.

Figure 13:
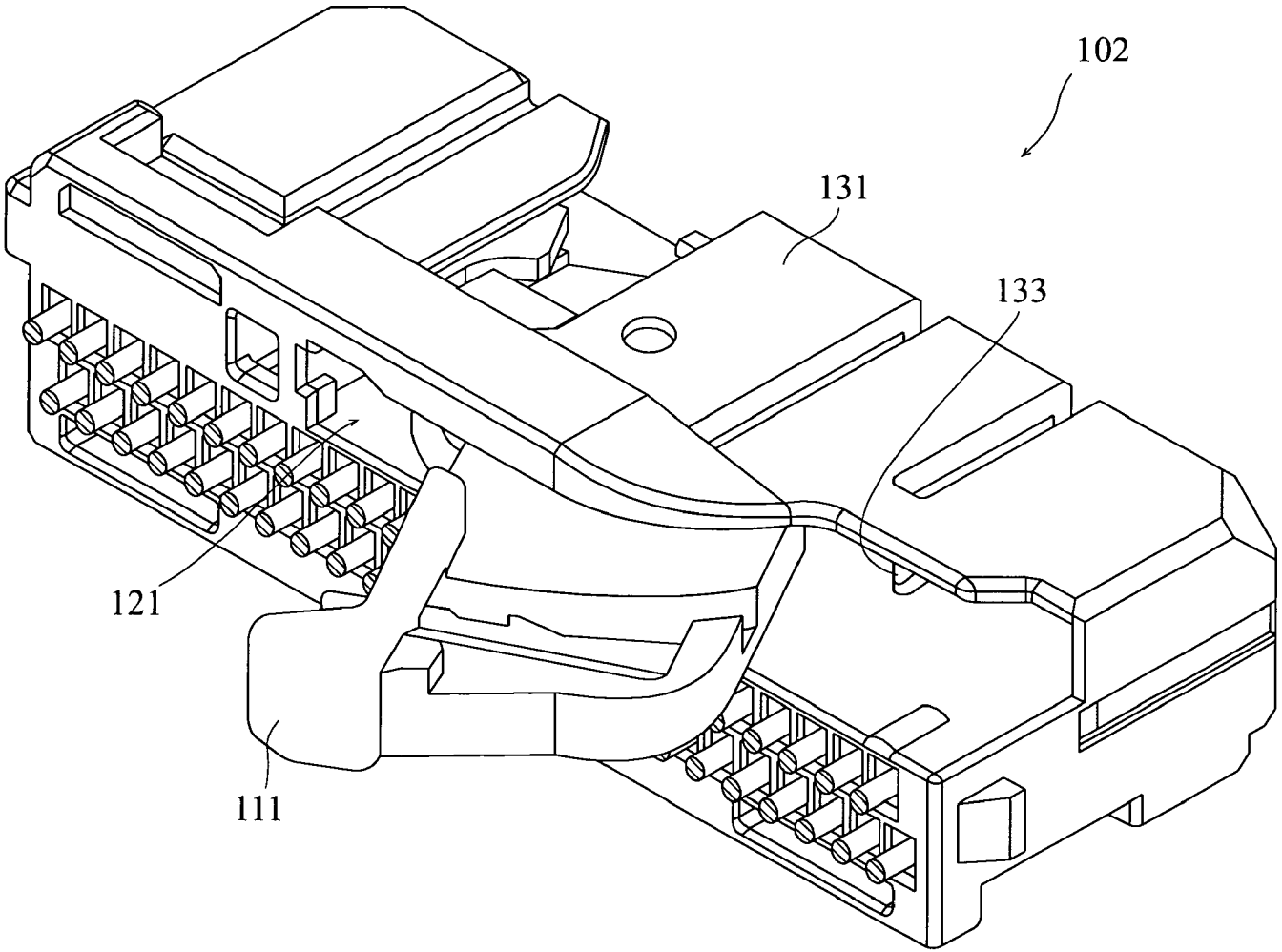
FIG. 13 is a view schematically showing a lever connector according to a second embodiment of the present invention.

Referring to FIG. 13, a connector assembly according to a second embodiment comprises a lever connector 102 and a mating connector (not shown). The lever connector 102 includes a lever 111 and a lever accommodation portion 121. The lever connector 102, the lever 111, and the lever accommodation portion 121 have the structure different from the first embodiment. The other members are similar to the first embodiment and the description therefor will be omitted.

Figure 14:
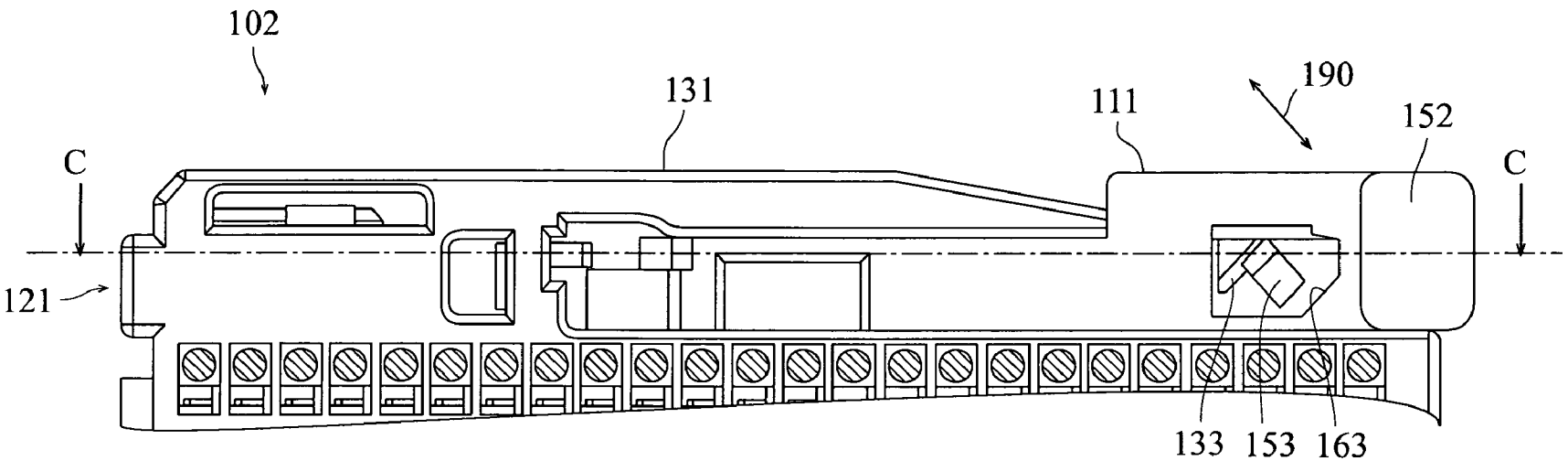
FIG. 14 is a front view schematically showing a part of the lever connector of FIG. 13.

Referring to FIG. 14, the lever 111 is in the connection position. An engagement portion 133 is formed on a lower surface of an upper plate 131 and is extending toward inside the lever accommodation portion 121. The engagement portion 133 has a contact plane 137.

Figure 15:
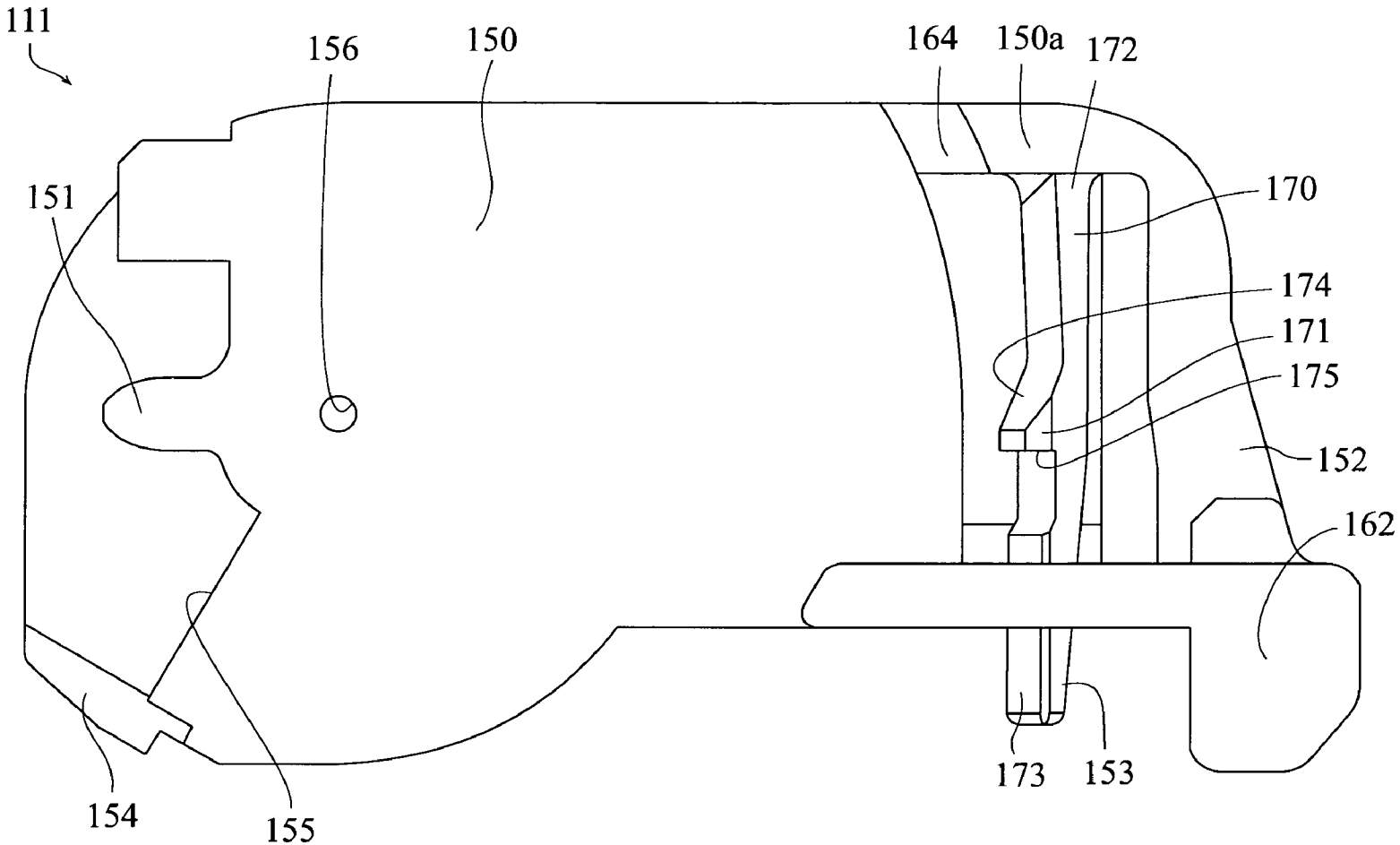
FIG. 15 is a top plan view schematically showing a lever included in the lever connector of FIG. 13.

Referring to FIG. 15, the lever 111 has a main plate portion 150, a lever cam portion 151, a supporter portion 150*a*, a guard portion 152 and an arm 153, an engagement portion 154, a surface 155 and a hole 156. The lever cam portion 151, the engagement portion 154, the surface 155 and the hole 156 function similar to the lever cam portion 51, the engagement portion 54, the surface 55 and the hole 56, respectively, of the first embodiment. The supporter portion 150*a* extends from the main plate portion 150 and is formed with a guide portion 164, which is positioned close to the main plate portion 150.

The guard portion 152 has a long portion and a short portion which constitute an L-like shape. The long portion of the guard portion 152 extends from an end of the supporter portion 150*a*. The short portion of the guard portion 152 extends between the long portion of the guard portion 152 and the main plate portion 150. On the corner of the L-like shaped guard portion 152, a handle portion 162 is formed.

Figure 16:
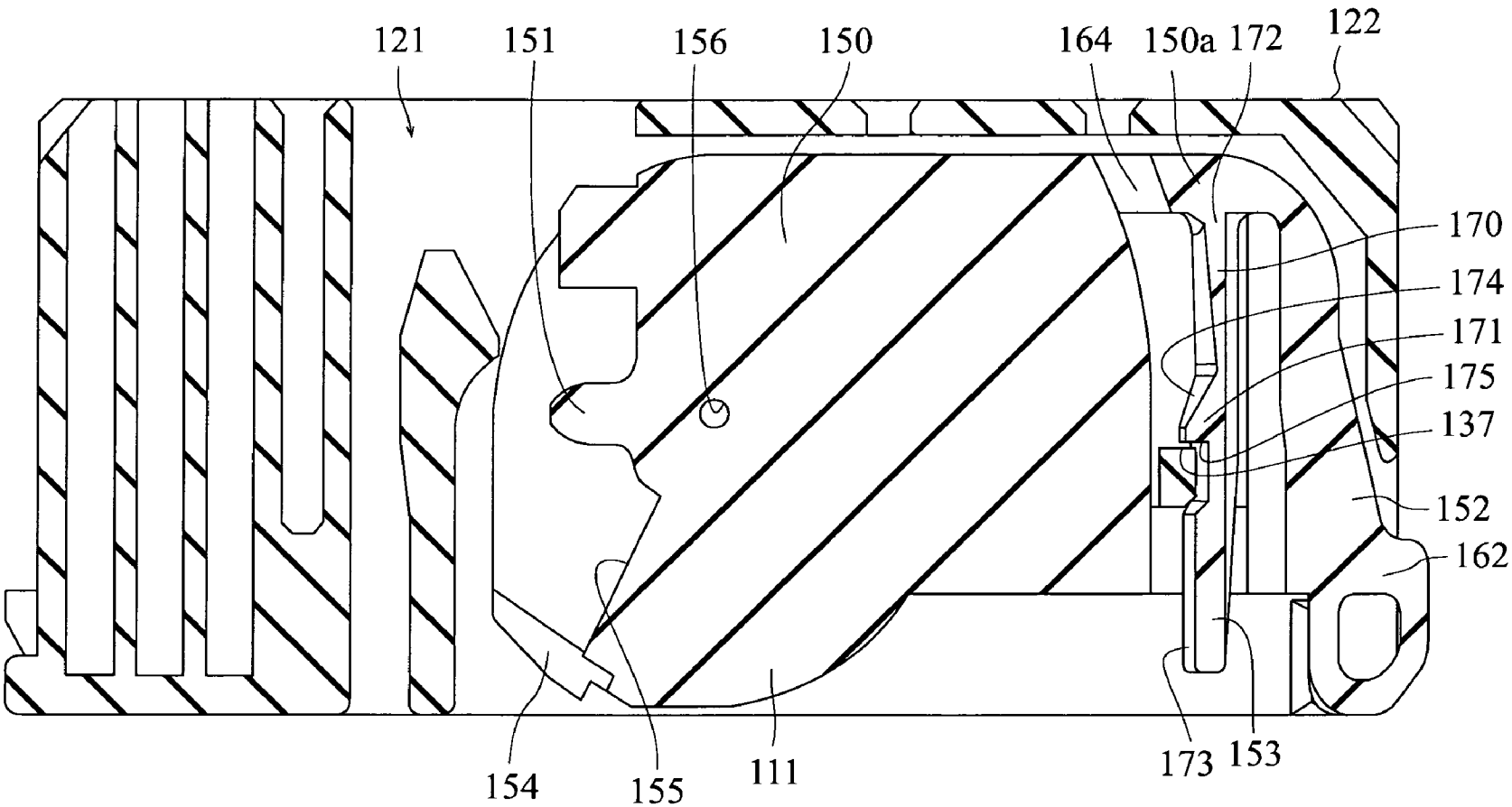
FIG. 16 is a cross-sectional view schematically showing the lever connector taken along lines C-C of FIG. 14.

Referring to FIGS. 15 and 16, the arm 153 has a bar-like shape and extends from the supporter portion 150*a*. The arm 153 has a main portion 170, an engagement portion 171, a base end 172 and a free end 173. The base end 172 is integrally formed with the supporter portion 150*a*. The free end 173 protrudes beyond the guard portion 152. The arm 153 is bendable in a direction 190 which is inclined with respect to the axial direction as illustrated in FIG. 14.

The arm 153 has a longitudinal direction extending from the base end 172 to the free end 173. The arm 153 also has a width in the direction 190 and a thickness perpendicular to the direction 190. The width of the arm 153 is smaller than the thickness so that the arm 153 is easily bent in the direction 190.

Referring to FIG. 16, the engagement portion 171 in integrally formed with the main portion 170. The engagement portion 171 protrudes from the main plate portion 150 in the direction 190 toward the hole 156 and the upper plate 131. The engagement portion 171 has a pressed portion 174 and a contact portion 175. The pressed portion 174 gently slopes toward the free end 173. The contact portion 175 is positioned at the end of the slope of the pressed portion 174. The contact portion 175 has a surface perpendicular to the main plate portion 150.

Upon rotation of the lever 111 from the disconnection position to the connection position, the engagement portion 133 presses the pressed portion 174 in the direction 190 so that the arm 53 is bent in the direction 190. When the engagement portion 133 gets over the pressed portion 174, the arm 153 returns back to its initial state so that the contact plane 137 of the engagement portion 133 is received by the contact portion 71. Thus, the lever 111 is locked at the connection position. With this structure, the locking state can be released by bending the arm in the direction 190, followed by operating the handle portion 162.

The present application is based on Japanese patent applications of JP2006-214011 filed before the Japan Patent Office on Aug. 7, 2006, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A lever connector connectable with a mating connector, comprising:

a lever comprising a main plate portion, a supporter portion and an arm, the main plate portion being laid in parallel with a predetermined plane, the supporter portion extending from the main plate portion, the arm being supported by the supporter portion and being bendable in a predetermined direction, the predetermined direction being not equal to a direction perpendicular to the predetermined plane, the arm being provided with a first engagement portion; and a housing comprising an accommodation portion and a second engagement portion, the second engagement portion being formed in the accommodation portion, the housing accommodating and rotatably supporting the main plate portion in the accommodation portion so that the lever is provided with rotary movement between a first position and a second position, the lever connector being connected to the mating connector and the first engagement portion being engaged with the second engagement portion upon rotation of the lever from the first position to the second position, the lever connector being disconnected from the mating connector upon rotation of the lever from the second position to the first position after the disengagement of the first engagement portion from the second disengagement portion by the bending of the arm.

2. The lever connector as claimed in claim 1, the mating connector comprising a mating cam portion, wherein the main plate portion of the lever is provided with a lever cam portion, the lever cam portion in cooperation with the mating cam portion forcing the lever connector to be connected to the mating connector upon rotation of the lever from the first position to the second position, the lever cam portion in cooperation with the mating cam portion forcing the lever connector to be disconnected from the mating connector upon rotation of the lever from the second position to the first position.

3. The lever connector as claimed in claim 1, wherein the predetermined direction is in parallel with the predetermined plane.

4. The lever connector as claimed in claim 1, wherein the first engagement portion has a first contact plane parallel to the predetermined direction, the second engagement portion having a second contact plane, the second contact plane being formed so that the second contact plane is brought into contact with the first contact plane to lock the lever at the second position upon engagement of the first engagement portion.

5. The lever connector as claimed in claim 1, wherein each of the first and the second contact planes is perpendicular to the predetermined plane.

6. The lever connector as claimed in claim 1, wherein the arm has a base end and a free end, the base end being continuing to the supporter portion, the base end having a width in the predetermined direction and a thickness in a direction perpendicular to the predetermined direction, the width being smaller than the thickness.

7. The lever connector as claimed in claim 6, wherein the free end has another width larger than the width of the base end.

8. The lever connector as claimed in claim 6, wherein the lever further comprises a guard portion extending from the main plate portion and the support portion, the guard portion guarding the arm with the free end projecting beyond the guard portion in the direction perpendicular to the predetermined direction.

9. The lever connector as claimed in claim 1, wherein the second engagement portion has a shape that forces the arm to be bent upon rotation of the lever from the first position to the second position so that the arm is bent in the predetermined direction.

10. The lever connector as claimed in claim 1, wherein:

the lever further comprises a third engagement portion protruding from the main plate portion;

the housing further comprises a stopper, the stopper extending inside the accommodation portion and being bendable in the predetermined plane, the stopper being provided with a fourth engagement portion;

the third engagement portion is engaged with the fourth engagement portion upon rotation of the lever from the second position to the first position; and the lever is locked at the first position by the engagement of the third engagement portion and the fourth engagement portion and is prevented from moving to the second position.

11. The lever connector as claimed in claim 10, wherein the stopper has a shape that is designed to disengage the fourth engagement portion from the third engagement portion upon preliminary fitting of the lever connector to the mating connector.

12. The lever connector as claimed in claim 10, wherein:

the lever further comprises a first lock portion protruding from the main plate portion;

the housing further comprises a second lock portion; and upon rotation of the lever from the first position to the second position, the first lock portion is brought into contact with the second lock portion so that the lever is locked at the first position and is prevented from rotating beyond the first position.

* * * * *